United States Patent [19]

Rabin et al.

[11] 4,073,074

[45] Feb. 14, 1978

[54] LADIES SHOE CONSTRUCTION

[75] Inventors: Harry H. Rabin, Miami; Florencio P. Aquino, Hialeah, both of Fla.

[73] Assignee: Miami Footwear Corporation, Miami, Fla.

[21] Appl. No.: 755,199

[22] Filed: Dec. 29, 1976

[51] Int. Cl.[2] ..... A43B 13/28; A43D 9/00

[52] U.S. Cl. ..... 36/104; 36/104; 12/142 J

[58] Field of Search ..... 36/83, 104, 92, 24.5, 36/69, 34 R; 12/142 R, 142 J

[56] References Cited

U.S. PATENT DOCUMENTS

| | | | |
|---|---|---|---|
| 1,606,055 | 11/1926 | Brauner et al. | 36/24.5 |
| 2,165,427 | 7/1939 | Vigorith et al. | 36/24.5 |
| 2,239,411 | 4/1941 | Cangemi | 36/24.5 |

*Primary Examiner*—Patrick D. Lawson

*Attorney, Agent, or Firm*—Clarence A. O'Brien; Harvey B. Jacobson

[57] ABSTRACT

A shoe for ladies in which the outsole and heel are uniquely associated so that a portion of the outsole forms the complete bottom construction or bottom covering or sole for the heel and the heel seat provides a continuous surface engaging the insole in the shank area. The heel is generally triangular in configuration and the surface defining the heel seat is received in a slot formed in the outsole by the portion of the outsole which defines the bottom construction for the heel.

5 Claims, 5 Drawing Figures

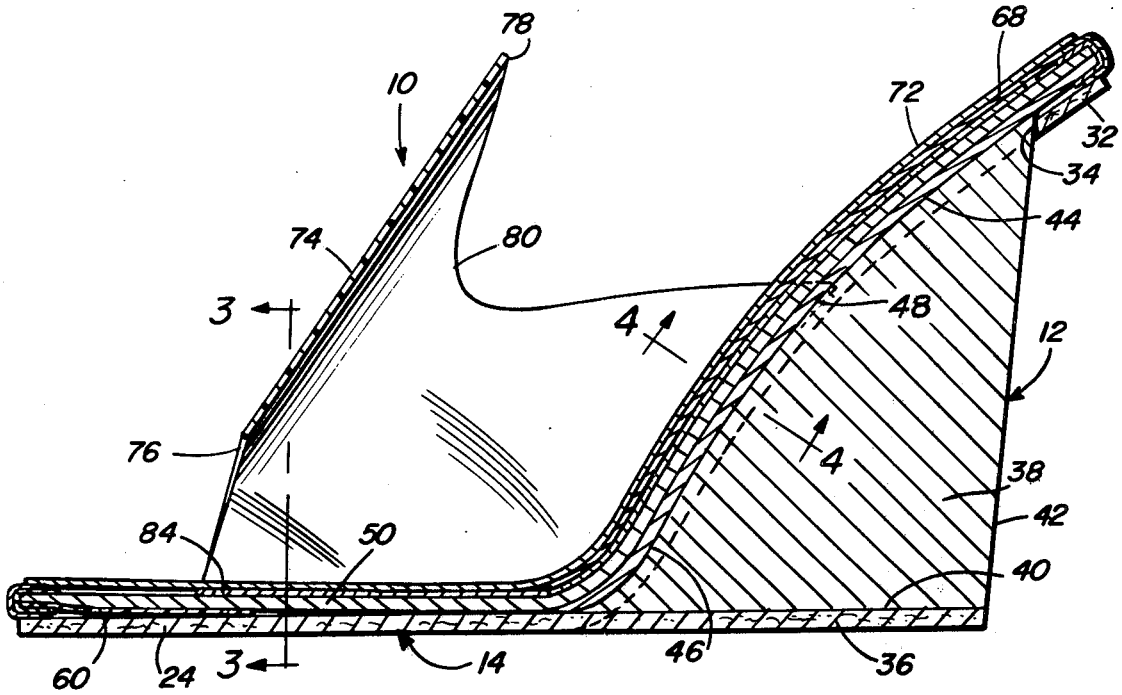

78
82
84
22
80
74
76

70
18
68
20
56
62
44
16
50
54
32
34
48
58
42
52
46
30
38
12
40
28
26
36
14
24

LADIES SHOE CONSTRUCTION

BACKGROUND OF THE INVENTION

1. Field of the Invention

The present invention generally relates to a shoe construction embodying a generally wedge-type heel having a heel seat conforming with and supporting the heel and shank area of the insole with the outsole of the shoe including a cut-out tongue defining the complete bottom construction for the heel.

2. Description of the Prior Art

In the construction of shoes for women, conventional practice involves the provision of a heel of predetermined height supporting the rear portion of the shoe with a rigid shank being provided in the sole of the shoe to provide support from the heel seat to the forepart of the sole which underlies the ball of the foot thereby supporting the arch. Other shoe constructins are known in which one piece soles are utilized in which the sole is of varying thickness and constructed of resilient material such as crepe rubber and the like. Also, shoe structures employing wedge-type heels are known in which the heel seat engages the outsole and provides support for the arch of the foot. The following U.S. patents disclose exemplary developments in this field: U.S. Pat. Nos. 889,182, and 2,555.590.

SUMMARY OF THE INVENTION

An object of the present invention is to provide a ladies' shoe construction in which the outsole is provided with a tongue cut out from the rear portion of the outsole and which forms a continuation of the forepart of the outsole in underlying relation to the bottom surface of a heel and thus forms a complete bottom construction for the heel of unitary construction thus simplifying the construction of the shoe.

Another object of the present invention is to provide a shoe construction in accordance with the preceding object in which the slot-like opening formed in the outsole by the tongue receives the heel seat of the heel with the width of the heel being substantially equal to the width of the slot.

A further important object of the invention is to provide a ladies' shoe construction which is simple in construction, inexpensive to manufacture, long lasting, comfortable to wear and capable of being constructed with different appearance characteristics.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 5:
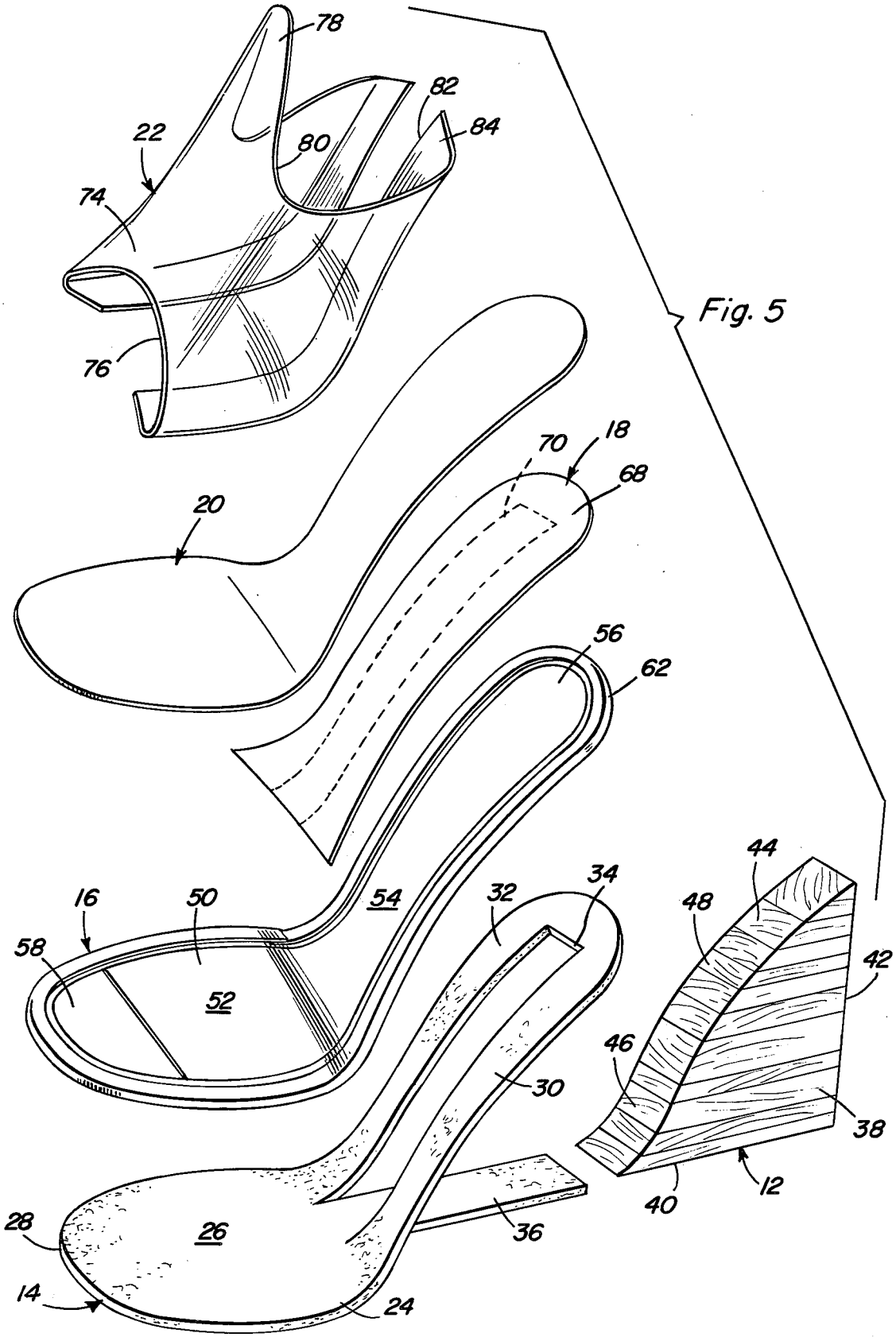
FIG. 5 is an exploded group perspective view of the shoe components.

Referring now specifically to the drawings, the shoe of the present invention is generally designated by reference numeral 10 and includes components oriented in the manner illustrated in FIG. 5 including a heel 12, an outsole 14, an insole 16, a filler 18, a liner 20 and an upper 22.

The outsole 14 includes an elongated panel 24 of leather of desired thickness having some degree of flexibility and including a large forepart 26 which includes a rounded toe portion 28. Extending rearwardly from the forepart 26 is a narrow shank portion 30 terminating in a rounded heel portion 32 with the shape and configuration of the outsole conforming with the foot shape with the outsole for the right foot shoe being offset opposite to the outsole for the left foot shoe in a well known and conventional manner. The panel 24 is provided with an elongated slot 34 extending from the rear of the forepart 26 to the heel portion 32 as illustrated in FIG. 5 with the slot 34 being defined by a tongue 36 which is integral with the panel 24 and joins integrally with and forms a continuation of the rear edge of the forepart 26 as illustrated in FIG. 5. The tongue 36 actually forms the heel top lift in a manner described hereinafter when the shoe components are assembled.

Figure 1:
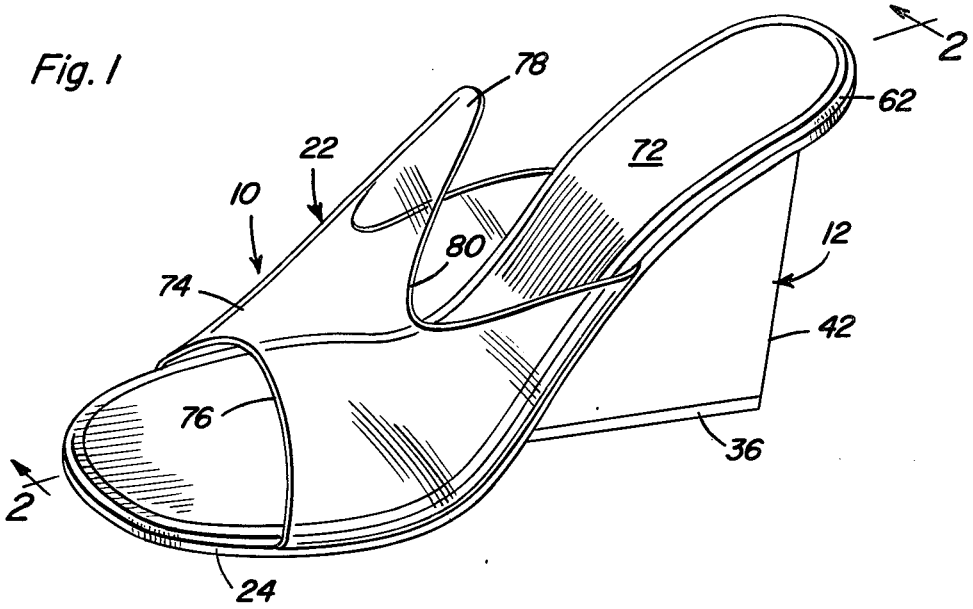
FIG. 1 is a perspective view of a shoe constructed in accordance with the present invention.
Figure 2:
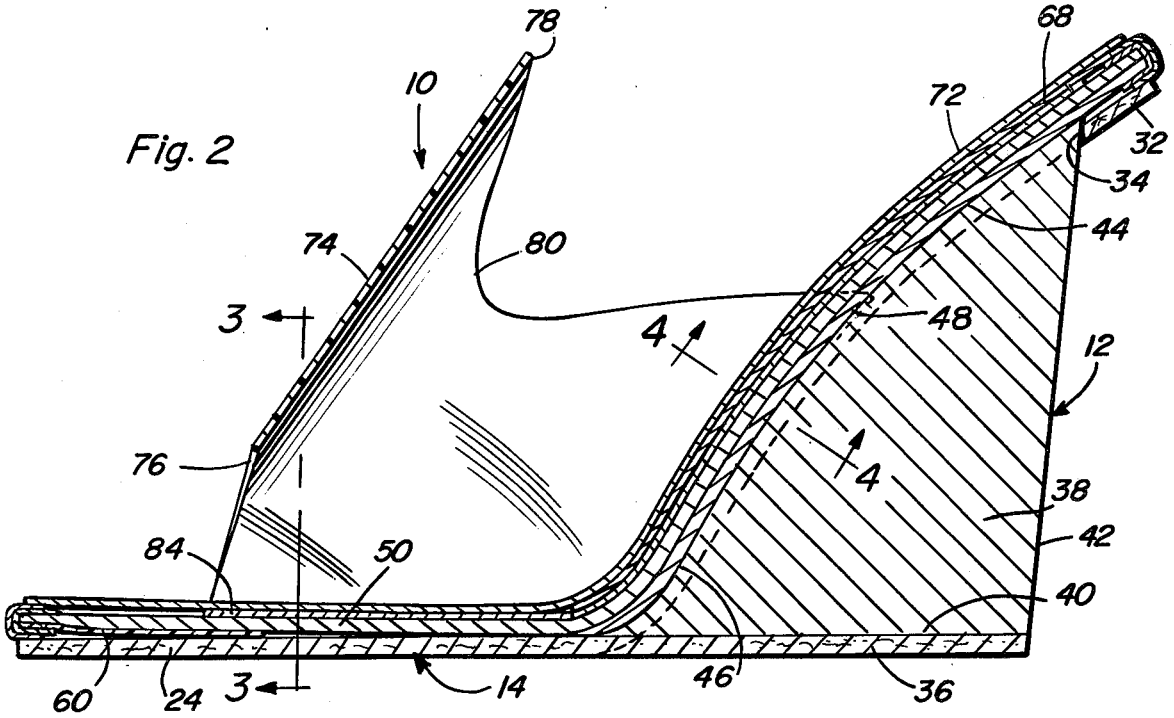
FIG. 2 is a longitudinal, vertical sectional view taken substantially upon a plane passing along section line 2—2 of FIG. 1, illustrating the structural details and associational relationships of the components of the shoe.
Figure 4:
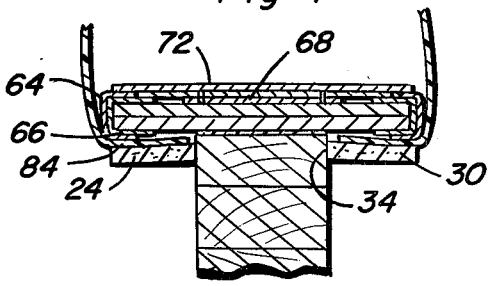
FIG. 4 is a transverse, sectional view, taken substantially upon a plane passing along section line 4—4 on FIG. 2, illustrating further structural details of the shoe.

The heel 12 includes a generally triangular body or block of material 38 having a generally horizontal bottom surface 40 and a vertical rear surface 42 and a diagonally extending inclined heel seat 44 which extends from the upper edge of the rear surface 42 to the forward edge of the bottom surface 40 of the heel 12 with the heel seat being provided with a slight inwardly curved portion 46 adjacent the lower extremity thereof as illustrated in FIGS. 2 and 5 with the central portion of the heel seat being slightly convex as at 48. When the heel 12 is assembled with the outsole 14, the tongue 36 is disposed under the bottom surface 40 and provides a top lift therefor. The free rear end of the tongue 36 terminates flush with the rear surface 42 of the heel and the slot 34 receives the heel seat 44 therein. As illustrated in FIGS. 4 and 5, the width of the body or block 38 is substantially less than the width of the shank portion 30 and is substantially the same width as the tongue portion 36 so that the heel seat will be received in the slot 34.

The insole 16 includes an elongated panel 50 including a forepart 52 a shank area 54 and a rounded heel portion 56. The insole also includes a toe portion 58 which includes an underlying reinforcement panel 60 of a more rigid material then the panel 50. The panel 50 is constructed of a paper-like material such as dense cardboard, fiberboard or the like which may vary in thickness and rigidity with the forepart 32 being relatively flexible and thin whereas the shank portion 54 and heel portion 56 may be relatively thicker and more rigid. The insole 16 is provided with peripheral stripping 62 which is in the form of a pair of tape-like layers 64 and 66 which are adhesively secured to each other and to the insole with the outermost tape 64 being provided with a decorative external surface. Positioned in overlying relation to the shank and heel portion of the insole 16 is a filler 18 which includes a flexible panel 68 disposed in overlying relation to the shank portion 54 and heel portion 56 of the insole with the central portion of the panel 68 including an underlying cushioning layer 70 secured thereto as by stitching or the like with this cushioning layer generally being aligned with the heel seat 44 to provide a cushion for the heel and arch portion of the foot of the wearer. Also, the undersurface of the filler 18 may be provided with a decorative surface comparable to the decorative surface of the outer tape 64 so that the juncture therebetween will be continuous.

The liner 20 includes a panel 72 conforming in configuration and shape to the insole 16 with the liner being constructed of a heavy fabric material having the upper surface thereof provided with a decorative finish comparable with the exterior of the edge of the insole 16 as formed by the tape 64. The liner and filler may be incorporated into a single component with the cushioning material being secured to the undersurface of the liner or the filler may be a separate component secured to the insole between the liner and insole with the filler being in the form of a cushioning material such as cardboard, felt, rubber or the like to cushion the engagment of the arch and heel portion of the foot with the shoe.

Figure 3:
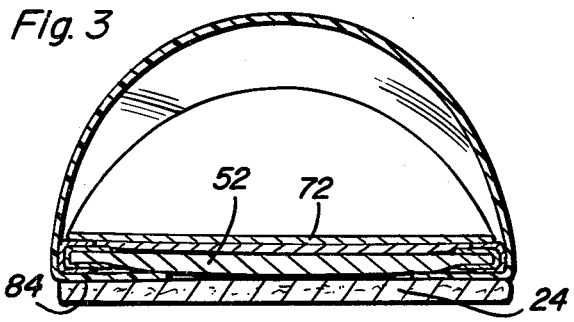
FIG. 3 is a transverse, sectional view, taken substantially upon a plane passing along section line 3—3 on FIG. 2, illustrating further structural details of the components of the shoe.

The upper 22 includes a panel 74 having a concave forward edge 76 and a projecting rear upper edge 78 and concave side rear edge portions 80. The free edges 82 of the panel 74 are inturned as at 84 and are disposed between the outsole 14 and the insole 10 as illustrated in FIGS. 3 and 4 thus securing the upper in position across the forepart and lower portion of the shank of the shoe. The panel 74 is of a flexible material and may be transparent plastic or a plastic material tinted in any suitable color or any other suitable flexible material such as leather, fabric or the like. All of the components are secured together by a suitable cement, adhesive material or the like with the finished shoe being illustrated in FIGS. 1–5. The heel 12 may be of transparent plastic material, tinted plastic material, laminated wood, covered with a suitable decorative material or the like which may be the same as the decorative finish provided on the liner 20 and the stripping 62. Usually, the outsole is left in its natural leather state to provide an attractive shoe structure. The heel 12 may be provided with a notch in the bottom surface thereof, a notch in the rear thereof or of any other construction as long as the heel seat 44 provides a support for the insole and liner thereby providing support for the arch of the foot without utilizing a rigid shank in the sole construction.

The heel may be attached to the shoe by stapling and/or cementing depending upon the particular materials utilized. The heel, outsole, insole, filler and upper may be constructed of natural or synthetic materials having desired decorative characteristics depending upon the design characteristics desired for the shoe. The dimensional characteristics and shapes or configurations of the heel may vary as long as the width and length of the heel is such as to closely fit into the slot thus leaving the perimeter of the slot and the perimeter of the outsole continuous.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A shoe comprising an outsole, an insole overlying the outsole, an upper secured to the outsole and insole and a heel supporting the rear of the shoe, said outsole including a panel of unitary construction and including a forepart, a shank portion and heel portion, said outsole including a slot formed in the shank and heel portion defined by a tongue forming an extension of the forepart and engaged with the bottom surface of the heel to complete the bottom construction for the heel, said heel including a heel seat received in the slot and extending substantially throughout the length and width of the slot with the width of the heel being less than the width of the shank and heel portion of the outsole.

2. The structure as defined in claim 1 wherein said heel is generally triangular in configuration with the heel seat including convexly and concavely curved areas conforming generally with the contours of the arch of the foot for supporting the same, said tongue being substantially in the same horizontal plane as the forepart of the outsole and being secured to the bottom surface of the heel.

3. The structure as defined in claim 1 wherein said insole is adhesively secured to the outsole and to the heel seat, said upper including inturned lower edges received between the insole and outsole and cemented thereto.

4. The structure as defined in claim 1 wherein said heel is constructed of any material sufficiently durable to comply with the requirements for proper construction of women's shoes such as wood, acrylic or the like.

5. The method of constructing a shoe of the type having an outsole, an insole, an upper and a heel comprising the steps of forming a tongue within the confines of the outsole with one end of the tongue being unitary with the rear of the forepart of the outsole and the remainder of the tongue being free of the outsole thereby providing a slot in the outsole when the tongue is oriented horizontally and the rear portion of the outsole is upwardly inclined, inserting a heel between the tongue and insole, and securing the heel seat to the insole within the slot in the outsole and securing the tongue to the bottom surface of the heel thereby completing the bottom construction of the heel.

* * * * *